US006623331B2

(12) United States Patent
Sevilla et al.

(10) Patent No.: US 6,623,331 B2
(45) Date of Patent: Sep. 23, 2003

(54) POLISHING DISK WITH END-POINT DETECTION PORT

(75) Inventors: Roland K Sevilla, Aurora, IL (US); James A. Hicks, Naperville, IL (US); Jeremy Jones, St. Charles, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 126 days.

(21) Appl. No.: 09/788,082

(22) Filed: Feb. 16, 2001

(65) Prior Publication Data

US 2002/0115379 A1 Aug. 22, 2002

(51) Int. Cl.[7] ..... B24B 49/12
(52) U.S. Cl. ..... 451/6; 451/533
(58) Field of Search ..... 451/6, 288, 287, 451/533, 527, 526, 548, 446, 60, 41

(56) References Cited

U.S. PATENT DOCUMENTS

| | | | | |
|---|---|---|---|---|
| 4,317,698 | A | | 3/1982 | Christol et al. |
| 4,462,860 | A | | 7/1984 | Szmanda |
| 4,490,948 | A | | 1/1985 | Hanstein et al. |
| 4,611,919 | A | | 9/1986 | Brooks, Jr. et al. |
| 4,660,979 | A | | 4/1987 | Muething |
| 4,674,236 | A | | 6/1987 | Kawakami et al. |
| 4,767,495 | A | | 8/1988 | Nishioka |
| 4,826,563 | A | | 5/1989 | Hassett et al. |
| 4,851,311 | A | | 7/1989 | Millis et al. |
| 4,918,872 | A | | 4/1990 | Sato et al. |
| 4,984,894 | A | | 1/1991 | Kondo |
| 4,998,021 | A | | 3/1991 | Mimasaka |
| 5,076,024 | A | | 12/1991 | Akagawa et al. |
| 5,166,080 | A | | 11/1992 | Schietinger et al. |
| 5,189,490 | A | | 2/1993 | Shetty et al. |
| 5,229,303 | A | | 7/1993 | Donnelly, Jr. et al. |
| 5,270,222 | A | | 12/1993 | Moslehi |
| 5,413,941 | A | | 5/1995 | Koos et al. |
| 5,433,650 | A | | 7/1995 | Winebarger |
| 5,433,651 | A | | 7/1995 | Lustig et al. |
| 5,441,598 | A | | 8/1995 | Yu et al. |
| 5,499,733 | A | | 3/1996 | Litvak |
| 5,584,146 | A | | 12/1996 | Shamouillan et al. |
| 5,628,862 | A | | 5/1997 | Yu et al. |
| 5,645,469 | A | | 7/1997 | Burke et al. |
| 5,663,797 | A | | 9/1997 | Sandhu |
| 5,674,116 | A | | 10/1997 | Merrill et al. |
| 5,681,216 | A | | 10/1997 | Jennings |
| 5,695,601 | A | | 12/1997 | Kodera et al. |
| 5,695,660 | A | | 12/1997 | Litvak |
| 5,724,144 | A | | 3/1998 | Muller et al. |
| 5,725,420 | A | * | 3/1998 | Torii ..... 451/285 |
| 5,733,171 | A | | 3/1998 | Allen et al. |
| 5,795,218 | A | | 8/1998 | Doan et al. |
| 5,800,248 | A | | 9/1998 | Pant et al. |
| 5,838,448 | A | | 11/1998 | Aiyer et al. |
| 5,853,317 | A | | 12/1998 | Yamamoto |
| 5,882,251 | A | | 3/1999 | Berman et al. |
| 5,891,352 | A | | 4/1999 | Litvak |
| 5,910,846 | A | | 6/1999 | Sandhu |
| 5,930,588 | A | | 7/1999 | Paniccia |
| 5,963,781 | A | | 10/1999 | Winer |
| 5,972,162 | A | | 10/1999 | Cesna |
| 6,014,218 | A | | 1/2000 | Bradl et al. |
| 6,045,433 | A | | 4/2000 | Dvir et al. |
| 6,045,439 | A | | 4/2000 | Birang et al. |
| 6,068,539 | A | | 5/2000 | Bajaj et al. |
| 6,068,540 | A | | 5/2000 | Dickenscheid et al. |
| 6,074,287 | A | | 6/2000 | Miyaji et al. |
| 6,077,147 | A | | 6/2000 | Yang et al. |
| 6,095,902 | A | | 8/2000 | Reinhardt |
| 6,102,775 | A | | 8/2000 | Ushio et al. |
| 6,106,662 | A | * | 8/2000 | Bibby, Jr. et al. ..... 156/345 |
| 6,106,728 | A | | 8/2000 | Iida et al. |
| 6,108,091 | A | | 8/2000 | Pecen et al. |
| 6,108,092 | A | | 8/2000 | Sandhu |
| 6,110,752 | A | | 8/2000 | Litvak |
| 6,142,857 | A | | 11/2000 | Cesna |
| 6,146,242 | A | * | 11/2000 | Treur et al. ..... 451/6 |
| 6,159,082 | A | * | 12/2000 | Sugiyama et al. ..... 451/285 |
| 6,261,155 | B1 | * | 7/2001 | Jairath et al. ..... 451/6 |

FOREIGN PATENT DOCUMENTS

| | | |
|---|---|---|
| JP | 07-052032 | 2/1995 |
| JP | 2002-124498 | 4/2002 |

* cited by examiner

*Primary Examiner*—Robert A. Rose

(57) ABSTRACT

The invention provides a polishing disk comprising (a) a body comprising a front surface, a back surface, and a peripheral surface, (b) a polishing surface, (c) an end-point detection port extending through the body from the front surface to the back surface, and (d) a drainage channel in fluid communication with the end-point detection port. The invention further provides a method of preparing such a polishing disk and a method of polishing a substrate with such a polishing disk.

28 Claims, 2 Drawing Sheets

POLISHING DISK WITH END-POINT DETECTION PORT

TECHNICAL FIELD OF THE INVENTION

This invention pertains to a polishing disk comprising an end-point detection port, a method for producing such a polishing disk, and a method of using such a polishing disk.

BACKGROUND OF THE INVENTION

The trend in the semiconductor industry continues to concentrate on reducing the size of semiconductor features while improving the planarity of their surfaces. More specifically, it is desirable to achieve a surface of even topography by decreasing the number and size of surface imperfections. A smooth topography is desirable because it is difficult to lithographically image and pattern layers applied to rough surfaces. A conventional method of planarizing the surfaces of these devices is to polish them with a polishing system.

The conventional method of planarizing semiconductor devices involves polishing the surface of the semiconductor with a polishing composition and a polishing disk, such as is accomplished by chemical-mechanical polishing (CMP). In a typical CMP process, a wafer is pressed against a polishing disk or pad in the presence of a polishing composition (also referred to as a polishing slurry) under controlled chemical, pressure, velocity, and temperature conditions. The polishing composition generally contains small, abrasive particles that mechanically abrade the surface of the wafer in a mixture with chemicals that chemically react with (e.g., remove and/or oxidize) the surface of the wafer. The polishing disk generally is a planar pad made from a continuous phase matrix material such as polyurethane. Thus, when the polishing disk and the wafer move with respect to each other, material is removed from the surface of the wafer mechanically by the abrasive particles and chemically by other components in the polishing composition.

In polishing the surface of a substrate, it is often advantageous to monitor the polishing process in situ. One method of monitoring the polishing process in situ involves the use of a polishing disk having an aperture or window. The aperture or window provides a portal through which light can pass to allow the inspection of the substrate surface during the polishing process. Polishing disks having apertures and windows are known and have been used to polish substrates, such as semiconductor devices. For example, U.S. Pat. No. 5,605,760 (Roberts) describes a polishing pad having a transparent window formed from a solid, uniform polymer, which has no intrinsic ability to absorb or transport a polishing composition. U.S. Pat. No. 5,433,651 (Lustig et al.) discloses a polishing pad wherein a portion of the pad has been removed to provide an aperture through which light can pass. U.S. Pat. Nos. 5,893,796 and 5,964,643 (both by Birang et al.) disclose removing a portion of a polishing disk to provide an aperture and placing a transparent polyurethane or quartz plug in the aperture to provide a transparent window, or removing a portion of the backing of a polishing disk to provide a translucency in the disk. While these devices with apertures or windows are initially effective for end-point detection, the polishing composition potentially can pool at the aperture and/or degrade the surface of the transparent window. Both of these effects diminish the ability to monitor the polishing process.

Thus, there remains a need for improved polishing disks and associated methods. The invention provides such a polishing system and a method of preparing and using such a polishing disk. These and other advantages of the invention, as well as additional inventive features, will be apparent from the description of the invention provided herein.

BRIEF SUMMARY OF THE INVENTION

The invention provides a polishing disk comprising (a) a body comprising a front surface, a back surface, and a peripheral surface, (b) a polishing surface, (c) an end-point detection port extending through the body from the front surface to the back surface, and (d) a drainage channel in fluid communication with the end-point detection port. The presence of the drainage channel assists in preventing a build-up of the polishing composition in the end-point detection port that inhibits end-point detection of a polishing process. The invention further provides method of preparing such a polishing disk and a method of polishing a substrate with such a polishing disk.

DETAILED DESCRIPTION OF THE INVENTION

Figure 1:
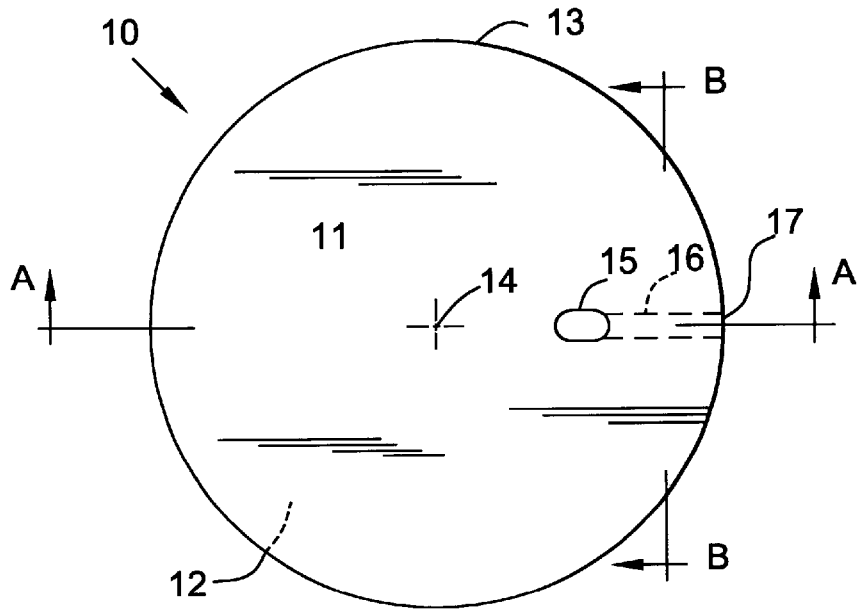
FIG. 1 depicts a top view of a polishing disk of this invention.

The invention provides a polishing disk and method for polishing a substrate, in particular semiconductor devices. As shown in FIG. 1, the body of the polishing disk (10) comprises front (11), back (12), and peripheral (13) surfaces. A polishing surface is provided by either the front or back surface. While the body of the polishing disk (10) can be of any suitable shape, it generally will be of a circular shape having an axis of rotation (14). An end-point detection port (15) extends through the body of the polishing disk from the front surface (11) to the back surface (12). A drainage channel (16) is in fluid communication with the end-point detection port (15).

In use, the polishing disk is put in contact with a substrate to be polished, and the polishing disk and substrate are moved relative to each other with a polishing composition therebetween. The end-point detection port enables in situ monitoring of the polishing process, while the drainage channel expedites removal of excess polishing composition from the detection port, which may inhibit monitoring of the polishing process. In particular, as the substrate to be polished is moved relative to the polishing disk, a portion of the substrate will be exposed (and available for inspection) upon passing over the detection port of the polishing disk. As a result of the inspection of the substrate during polishing, the polishing process can be terminated with respect to that substrate at a suitable point in time (i.e., the polishing end-point can be detected).

The body of the polishing disk can comprise any suitable material or combinations of materials. Preferably, the body of the polishing disk comprises a polymeric material, such as polyurethane. Any suitable material can be placed over the front and/or back surfaces of the polishing disk to provide the polishing surface. For example, the front surface can comprise another material different from the material of the body of the polishing disk to render the front surface a more suitable polishing surface for the substrate intended to be polished with the polishing disk.

Figure 2:
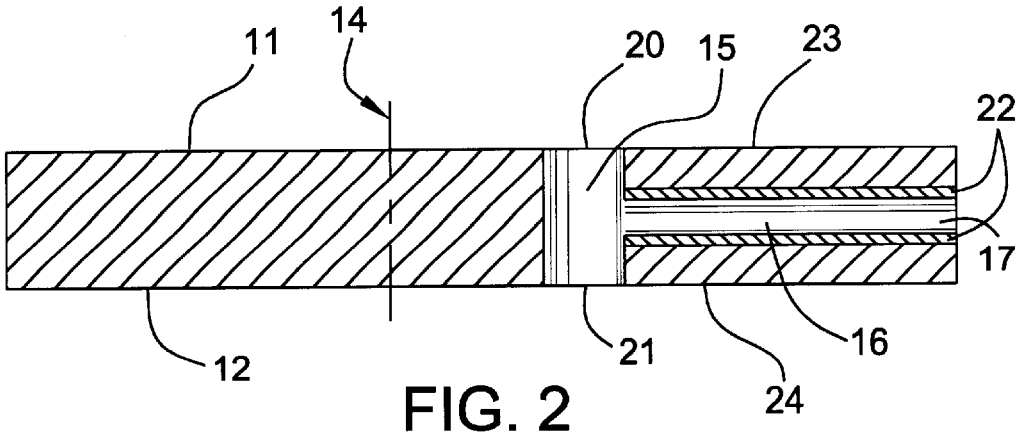
FIG. 2 depicts a side view of the polishing disk of FIG. 1 taken along line A—A and containing no sub-pad.

The end-point detection port (15) is an aperture with an opening (20) that extends from the front surface (11) to an opening (21) in the back surface (12), as shown in FIG. 2. The main function of the aperture is to enable the monitoring of the polishing process on the substrate being polished, during which time the substrate generally will be in contact and moving relative to the polishing surface of the polishing disk. The end-point detection port can be located in any suitable position on the polishing disk and can be oriented in any direction, preferably along the radial direction. The end-point detection port can have any suitable overall shape and dimensions. In order to provide the optimal removal of polishing composition, the edges of the port desirably are beveled, sealed, textured, or patterned, and the port is not closed to the flow of polishing composition (e.g., the port does not contain a plug, such as a transparent plug).

Figure 3:
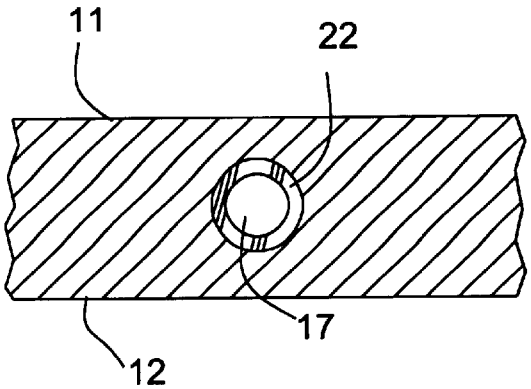
FIG. 3 depicts an edge view of the polishing disk of FIG. 1 taken along line B—B and containing no sub-pad.
Figure 4:
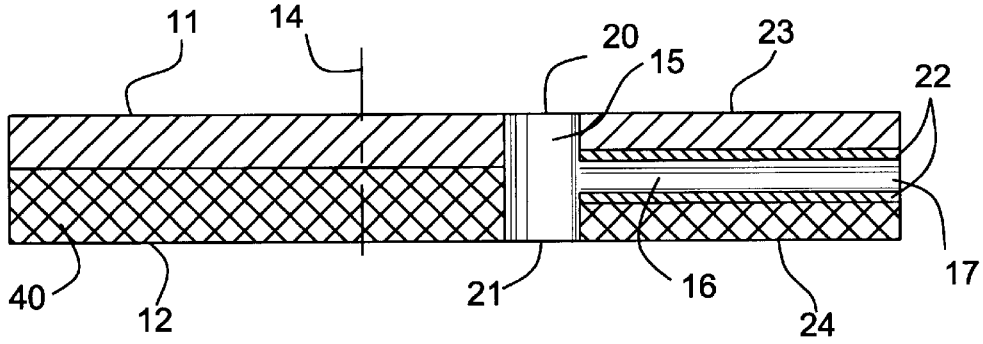
FIG. 4 depicts a side view of the polishing disk of FIG. 1 taken along line A—A and containing a sub-pad.
Figure 5:
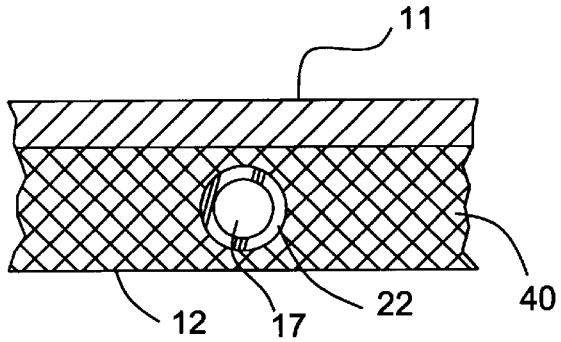
FIG. 5 depicts an edge view of the polishing disk of FIG. 1 taken along line B—B and containing a sub-pad.
Figure 6:
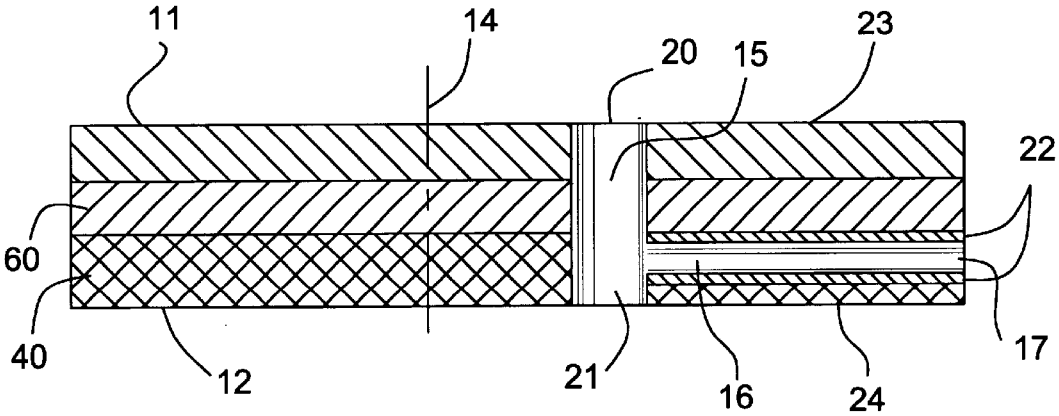
FIG. 6 depicts a side view of the polishing disk of FIG. 1 taken along line A—A and containing a stiffening layer and a sub-pad.

The drainage channel (16) is in fluid communication with the end-point detection port (15) as depicted in FIGS. 1 and 2. The drainage channel desirably connects the aperture (15) with an opening in the peripheral surface (17). The opening (17) can be of any suitably shape or size. The drainage channel (16) can be at any suitable position between the aperture (15) and the opening in the peripheral surface (17). It can be exposed to the front surface (11) or back surface (12) of the polishing disk or embedded in the body (10) of the polishing disk. When the drainage channel is exposed to the front or back surface of the polishing disk, the drainage channel forms a groove in the surface of the polishing disk. Preferably, the drainage channel (16) is covered (e.g., throughout its length) by a region in both the front surface (23) and back surface (24) of the polishing disk. The drainage channel can consist of a single channel or multiple channels, which can be of the same or different constructions and configurations. The drainage channel generally will have a thickness of 10–90% of the thickness of the polishing disk. The drainage channel itself can be an integral part of the polishing disk (i.e., a channel formed partially or wholly from and within the polishing disk), or the drainage channel can comprise a discrete element of any suitable material. The drainage channel can be of any suitable configuration, e.g., a tube (22). In a polishing disk where the drainage channel comprises a discrete tube, the tube preferably is a polymeric material in any suitable width and cross-sectional shape (e.g., a circular shape (22) as shown in FIG. 3 or rectangular shape). The drainage channel of the polishing disk can have any suitable compressibility, but desirably is compressible to approximately the extent of the compressibility of the material of the body of the polishing disk, The polishing disk further can comprise a sub-pad (40), as shown in FIGS. 4 and 5. The sub-pad can comprise any suitable material, preferably a material that is nonabsorbent with respect to the polishing composition. The sub-pad can have any suitable thickness and can be coextensive with any portion, preferably all, of a surface of the polishing disk, with an appropriate absent portion in alignment with the end-point detection port. The sub-pad desirably is located opposite the surface of the polishing disk intended to be in contact with the substrate to be polished with the polishing disk (i.e., opposite the polishing surface) and desirably forms the surface of the polishing disk intended to be in contact with the platen or other structure of the polishing device that supports the polishing disk in the polishing device. The drainage channel preferably is located within the sub-pad, when the polishing disk comprises a sub-pad. In order to add local stiffness to the port, a stiffening layer (60) can be used in conjunction with the polishing disk. The stiffening layer can comprise any suitable material and, when used with a polishing disk comprising a sub-pad, desirably is placed between the sub-pad and the remainder of the polishing disk as shown in FIG. 6. Preferably the stiffening layer comprises a polymeric material, such as polycarbonate. The stiffening layer can have any suitable thickness to attain the desired level of stiffness. The stiffening layer can be added to only the area surrounding the drainage channel or as a layer coextensive with some or all of the remainder of the entire polishing pad with an appropriate absent portion in alignment with the end-point detection port.

The invention also includes a method of preparing such a polishing disk. The method comprises (a) providing a body with a front surface, a back surface, and a peripheral surface, (b) providing a polishing surface on the body, (c) forming an aperture extending from the front surface to the back surface to provide an end-point detection port, and (d) forming a drainage channel in the body in fluid communication with the aperture, so as to form a polishing disk from the body, whereby the polishing disk comprises the polishing surface, the end-point detection port, and the drainage channel. The aforementioned items, e.g., body, polishing surface, end-point detection port, and drainage channel, are as described above.

The invention also provides a method of polishing a substrate comprising the use of a polishing disk of the invention, for example, by contacting the polishing pad with the surface of the substrate and moving the polishing disk relative to the surface of the substrate in the presence of a polishing composition. Desirably, the polishing of the substrate is monitored by any suitable technique through the end-point detection port. Rather than collect in the end-point detection port, at least some, and desirably all or substantially all, of the polishing composition entering the end-point detection port can flow through the drainage channel to the desired opening in the peripheral surface. Desirably the polishing pad is continually rotating during the polishing process, so the removal of polishing composition, which enters the end-point detection port, through the drainage channel is aided by centrifugal force and capillary action. Polishing composition flow through the drainage channel preferably is maintained so as to ensure end-point detection port clearance during the polishing process and accurate monitoring of the polishing of the substrate being polished. In general, the polishing composition entering the end-point detection port and the drainage channel can be collected, desirably after exiting the drainage channel through the opening in the peripheral surface. At least some, and possibly all or substantially all, of the collected polishing composition desirably is recycled for reuse in the polishing process.

The inventive method of polishing a substrate can be used to polish or planarize any substrate, for example, a substrate comprising a glass, metal, metal oxide, metal composite, semiconductor base material, or combinations thereof. The substrate can comprise, consist essentially of, or consist of any suitable metal. Suitable metals include, for example, copper, aluminum, tantalum, titanium, tungsten, gold, platinum, iridium, ruthenium, and combinations (e.g., alloys or mixtures) thereof. The substrate also can comprise, consist essentially of, or consist of any suitable metal oxide. Suitable metal oxides include, for example, alumina, silica, titania, ceria, zirconia, germania, magnesia, and combinations thereof. In addition, the substrate can comprise, consist essentially of, or consist of any suitable metal composite. Suitable metal composites include, for example, metal nitrides (e.g., tantalum nitride, titanium nitride, and tungsten nitride), metal carbides (e.g., silicon carbide and tungsten carbide), nickel-phosphorus, alumino-borosilicate, borosilicate glass, phosphosilicate glass (PSG), borophosphosilicate glass (BPSG), silicon/germanium alloys, and silicon/germanium/carbon alloys. The substrate also can comprise, consist essentially of, or consist of any suitable semiconductor base material. Suitable semiconductor base materials include single-crystal silicon, polycrystalline silicon, amorphous silicon, silicon-on-insulator, and gallium arsenide.

The inventive method is useful in the planarizing or polishing of many hardened workpieces, such as memory or rigid disks, metals (e.g., noble metals), inter-layer dielectric (ILD) layers, micro-electro-mechanical systems, ferroelectrics, magnetic heads, polymeric films, and low and high dielectric constant films. The term "memory or rigid disk" refers to any magnetic disk, hard disk, rigid disk, or memory disk for retaining information in electromagnetic form. Memory or rigid disks typically have a surface that comprises nickel-phosphorus, but the surface can comprise any other suitable material.

The inventive method is especially useful in polishing or planarizing a semiconductor device, for example, semiconductor devices having device feature geometries of about 0.25 $\mu$m or smaller (e.g., 0.18 $\mu$m or smaller). The term "device feature" as used herein refers to a single-function component, such as a transistor, resistor, capacitor, integrated circuit, or the like. The present method can be used to polish or planarize the surface of a semiconductor device, for example, in the formation of isolation structures by shallow trench isolation methods (STI polishing), during the fabrication of a semiconductor device. The present method also can be used to polish the dielectric or metal layers (i.e., metal interconnects) of a semiconductor device in the formation of an inter-layer dielectric (ILD polishing).

The inventive method of polishing a substrate can further comprise passing light (e.g., a laser) through the end-point detection port of the polishing disk and onto a surface of the substrate, for example, during the polishing or planarizing of a substrate in order to inspect or monitor the polishing process. Techniques for inspecting and monitoring the polishing process by analyzing light or other radiation reflected from a surface of the substrate are known in the art. Such methods are described, for example, in U.S. Pat. Nos. 5,196,353, 5,433,651, 5,609,511, 5,643,046, 5,658,183, 5,730,642, 5,838,447, 5,872,633, 5,893,796, 5,949,927, and 5,964,643. Because no plug is used in the end-point detection port in the polishing disk of this invention, complications from optical defects of the plug are removed. The end-point detection port can be utilized with any other technique for inspecting or monitoring the polishing process. Desirably, the inspection or monitoring of the progress of the polishing process with respect to a substrate being polished enables the determination of the polishing end-point, i.e., the determination of when to terminate the polishing process with respect to a particular substrate.

All of the references cited herein, including patents, patent applications, and publications, are hereby incorporated in their entireties by reference.

While this invention has been described with an emphasis upon preferred embodiments, those of ordinary skill in the art will appreciate that variations of the preferred embodiments can be used, and it is intended that the invention may be practiced otherwise than as specifically described herein. Accordingly, this invention includes all modifications encompassed within the spirit and scope of the invention as defined by the following claims.

What is claimed is:

1. A polishing pad comprising (a) a body comprising a front surface, a back surface, and a peripheral surface, wherein the body comprises a polymeric material and the peripheral surface comprises an opening, (b) a polishing surface, c) an end-point detection port extending through the body from the front surface to the back surface, and (d) a drainage channel that is covered by a region of the front surface, wherein the drainage channel is in fluid communication with the end-point detection port and the opening in the peripheral surface.

2. The polishing pad of claim 1, wherein the body of the polishing pad comprises a top pad that comprises the polishing surface and a sub-pad.

3. The polishing disk of claim 1, wherein the drainage channel is exposed to the front surface.

4. The polishing disk of claim 1, wherein the drainage channel is covered by a region of the front surface.

5. The polishing pad of claim 1, wherein the drainage channel is covered by a region of the back surface.

6. The polishing pad of claim 5, wherein the polishing pad further comprises a tube that forms the drainage channel.

7. The polishing pad of claim 6, wherein the tube comprises a polymeric material.

8. The polishing pad of claim 1, wherein the polishing surface is provided by a material placed over the front or back surface of the body.

9. The polishing pad of claim 2, wherein the drainage channel is located within the sub-pad.

10. The polishing pad of claim 1, wherein the polymeric material comprises polyurethane.

11. The polishing disk of claim 1, wherein the drainage channel has a compressibility about equal to the compressibility of the polymer material.

12. A method of preparing a polishing pad comprising (a) providing a body having a front surface, a back surface, and a peripheral surface, wherein the body comprises a polymeric material and the peripheral surface comprises an opening, (b) providing a polishing surface on the body, (c) forming an aperture extending from the front surface to the back surface to provide an end-point detection port, and (d) forming a drainage channel that is covered by a region of the front surface, wherein the drainage channel is in the body in fluid communication with the aperture and the opening in the peripheral surface, so as to form a polishing pad from the body, whereby the polishing pad comprises the polishing surface, the end-point detection port, and the drainage channel.

13. The polishing pad of claim 2, wherein the body of the polishing disk pad further comprises a stiffening layer.

14. The method of claim 12, wherein the drainage channel is exposed to the front surface.

15. The method of claim 12, wherein the drainage channel is covered by a region of the front surface.

16. The method of claim 12, wherein the drainage channel is covered by a region of the back surface.

17. The method of claim 16, wherein the drainage channel is formed by inserting a tube into the body.

18. The method of claim 17, wherein the tube comprises a polymeric material.

19. The method of claim 12, comprising placing a material over the front or back surface of the body to form the polishing surface.

20. The polishing pad of claim 1, wherein the end-point detection port is not closed to the flow of a polishing composition therethrough.

21. The method of claim 12, wherein the polymeric material comprises polyurethane.

22. The method of claim 12, wherein the drainage channel has a compressibility about equal to the compressibility of the polymer material.

23. A method of polishing a substrate comprising (a) providing a polishing pad of claim 1, (b) providing a substrate, (c) providing a polishing fluid to the polishing surface, the substrate, or both the polishing surface and the substrate, (d) contacting the polishing surface with the substrate, and (e) moving the polishing surface relative to the substrate to polish the substrate.

24. The method of claim 23, wherein at least some of the polishing fluid enters the end-point detection port during polishing and flows through the drainage channel.

25. The method of claim 24, further comprising passing light through the end-point detection port to monitor the polishing of the substrate.

26. The method of claim 25, wherein the light is laser light.

27. The method of claim 25, wherein the polishing process is terminated based on information derived from the monitoring of the polishing of the substrate.

28. The method of claim 24, further comprising recycling at least a portion of the polishing fluid from the drainage channel to the polishing surface and/or the substrate.

* * * * *